United States Patent [19]

Clark

[11] 4,069,773

[45] Jan. 24, 1978

[54] COMBINATION PASS-THROUGH AND DEAL TRAY FOR TELLERS

[76] Inventor: Larry G. Clark, 5532 Hollister Drive, Indianapolis, Ind. 46224

[21] Appl. No.: 697,066

[22] Filed: June 17, 1976

[51] Int. Cl.[2] ..... E05G 7/00

[52] U.S. Cl. ..... 109/19

[58] Field of Search ..... 109/10, 19; 232/44, 232/64, 65; 292/252; 312/211, 327

[56] References Cited

U.S. PATENT DOCUMENTS

| | | | |
|---|---|---|---|
| 1,890,587 | 12/1932 | Plym | 109/19 |
| 2,832,623 | 4/1958 | Golemon | 292/252 X |

FOREIGN PATENT DOCUMENTS

| | | | |
|---|---|---|---|
| 1,808,371 | 5/1970 | Germany | 109/19 |

*Primary Examiner*—Paul R. Gilliam
*Assistant Examiner*—David H. Corbin
*Attorney, Agent, or Firm*—Woodard, Weikart, Emhardt & Naughton

[57] ABSTRACT

A countertop with a teller window has an open-topped, specially shaped box under the window with a tray pivotally mounted in the top of the box for passage of small items under the window from the front of the counter to the rear, with the pivotal mounting of the tray enabling passage of larger items under the window while maintaining security of the space behind the window, from direct access to the space in front of the window.

6 Claims, 6 Drawing Figures

COMBINATION PASS-THROUGH AND DEAL TRAY FOR TELLERS

BACKGROUND OF THE INVENTION

1. Field of the Invention

This invention relates generally to security fixtures and equipment, and more particularly to a device by which comparatively large packages can be passed from the front to the rear of a security counter, without direct exposure of the space behind the counter to the space in front of the counter.

2. Description of the Prior Art

In the days when banks had teller "windows", a type of metal cagework was actually used at the window, with a small opening at the bottom of the cage for passage of currency, change, checks, deposit slips and the like from the teller behind the window to the customer in front of the window and vice versa. When items larger than the opening were to be passed, such as a payroll moneybag, the front of the cagework could be unlatched and swung open by the teller.

Subsequently, a more open design was adopted whereby a comparatively low window was provided between the teller and the customer, and over which large objects could be passed. Even more recent developments led to a more open space between the teller and the customer. Subsequently, however, due to increased instances of bank robberies, and particularly in some areas, not only banks, but taverns, filling stations, and other businesses have adopted increased security measures virtually isolating the space behind the counter from the space in front of the counter. This has led to problems in the passage of objects larger than coins and currency. The result has been adoption of several arrangements, one of which has been known for quite some time. That is a passageway having a door at each end with appropriate locking arrangements so that only one door can be opened at a time. Another arrangement is a lazy Susan. In many instances, such arrangements required too much space or presented obstacles to installation, particularly in existing counters.

SUMMARY OF THE INVENTION

Described briefly, in a typical embodiment of the present invention, an upwardly opening housing is disposed in a countertop and is of sufficient size that, when installed under a window as for a bank teller's counter, will permit passage of objects larger than the usual currency and change from the front of the counter to the rear of the counter, under the window. A plate is mounted in the upper portion of the housing and spaced below the bottom edge of the window to permit passage of currency and coins under the window in the usual type of transaction. However the plate can be tilted up on one side while the other side remains closed, and then up on the other side while the first side is closed, to admit a package at the one side and permit transfer thereof to the other side, without directly exposing the space on the one side of the window to the space on the other side of the window.

DESCRIPTION OF THE PREFERRED EMBODIMENT

Figure 1:
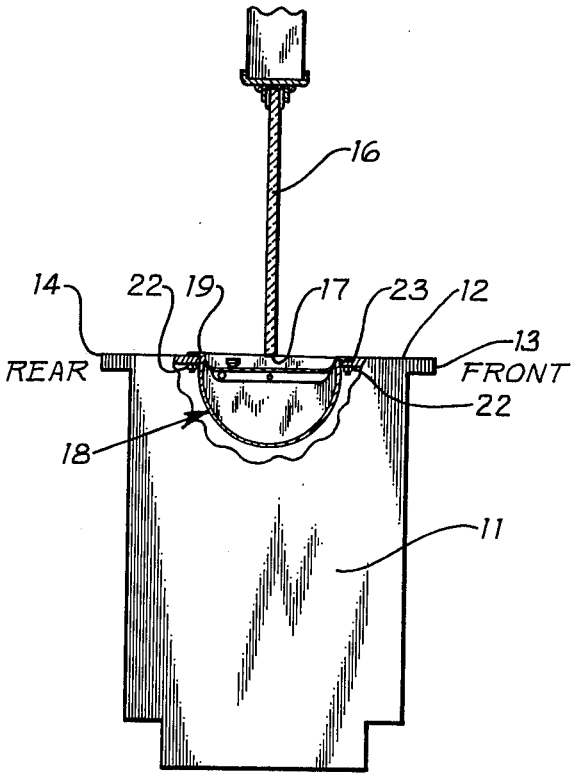
FIG. 1 is a section through a counter incorporating a typical embodiment of the present invention therein.

Referring now to the drawings in detail, and particularly FIG. 1, there is shown a counter 11 having a top 12 with a front edge 13 and rear edge 14. For purposes of example, we can assume that this is a bank counter and the customer stands in front of the front edge and the teller stands to the rear of the rear end. A clear, transparent bullet-resistant glass or plastic sheet can serve as a window 16, the lower edge 17 of which is approximately at the level of the countertop 12.

Figure 4:
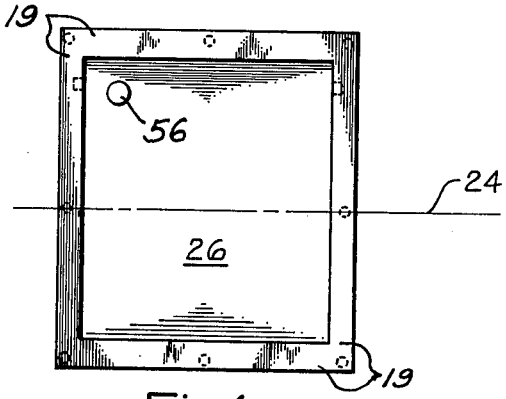
FIG. 4 is a top plan view of the combination pass-through and deal tray on a reduced scale.
Figure 5:
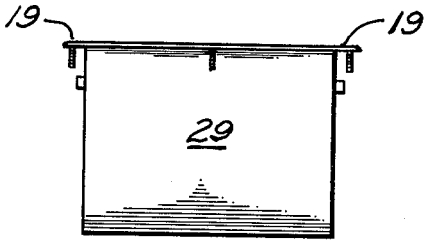
FIG. 5 is a front elevational view of the combination pass-through and deal tray on the same scale as FIG. 4.

According to a typical embodiment of the present invention, a semi-cylindrical housing 18 having a generally rectangular top as shown in FIG. 4 with a perimetrical flange 19 resting on top of the counter has downwardly projecting threaded studs 21 extending through holes in the top of the counter and receiving nuts 22 thereon, securing the flange to the countertop. A slight recess can be provided in the countertop if desired as indicated at 23 so that the top of the flange is flush with the plane of the top surface 12 of the counter.

Figure 2:
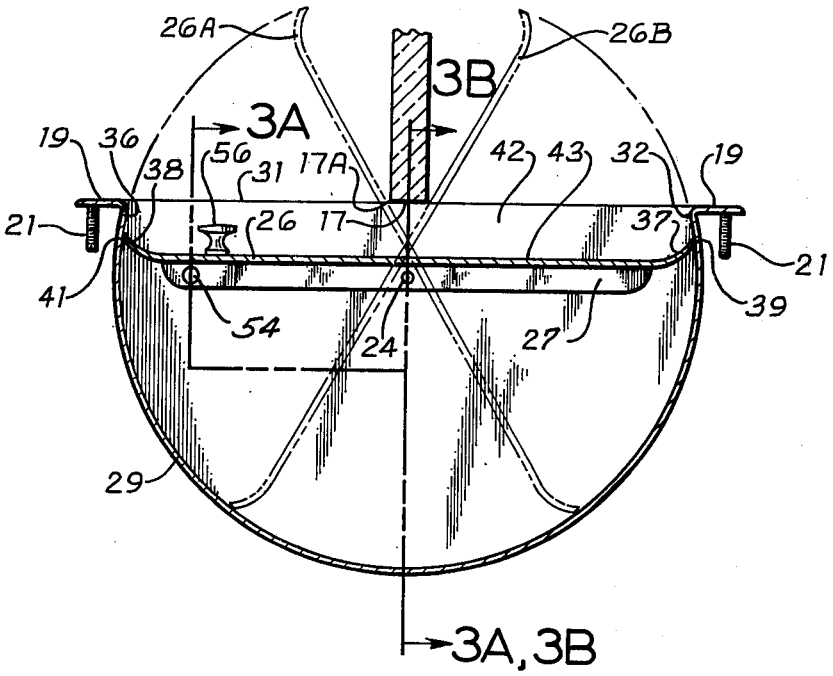
FIG. 2 is an enlarged section through the combination pass-through and deal tray of FIG. 1.
Figure 3A:
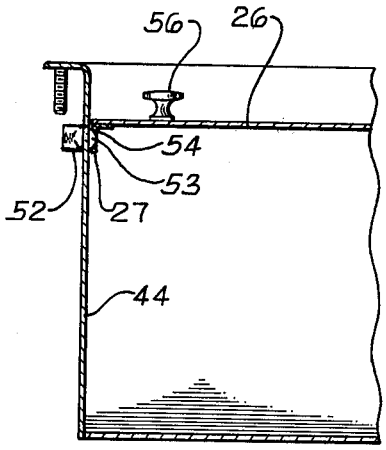
FIG. 3A is a section taken along line 3A—3A in FIG. 2 and viewed in the direction of the arrows.
Figure 3B:
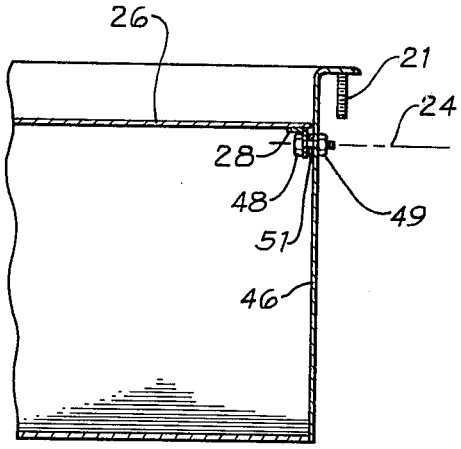
FIG. 3B is a cross-section taken at line 3B—3B in FIG. 2 and viewed in the direction of the arrows.

Some of the details will be better perceived by reference to FIGS. 2 and 3A and 3B. Referring to those figures, it will be seen that the housing is semi-cylindrical in shape, having a cylindrical axis 24 which also is the pivot axis for a plate 26 mounted in the upper portion of the housing and closing the top of the housing. The pivotal mounting is provided by means of two horizontally spaced downwardly projecting side flanges 27 and 28, which are actually the downwardly projecting flanges of angle section members welded to the underside of the plate 26. Since the center of the cylindrical wall 29 of the housing is below the housing top 31 defined by the perimetrical flange 19, the inner front wall 32 of the housing projects upwardly and rearwardly and the inner rear wall 36 projects upwardly and forwardly. This, in combination with the upwardly curved front end portion 37 of plate 26, and the upwardly curved rear end portion 38 of plate 26, together with the close spacing of the ends 39 and 41 of plate 26 with walls 32 and 36, respectively, of the housing, facilitates withdrawal of coins and papers from the ends of the space 42 between the plane of the countertop and the upper face 43 of plate 26. This together with the close proximity of the side edges of the plate 26 to the flat inside sidewalls 44 and 46 of the housing (this space being approximately 0.16 inch) effectively provides a deal tray in the top of the housing.

The pivotal mounting of the plate 26 to the housing is by means of a shoulder bolt 48 through flange 27 and flange 28 secured by a lock nut 49 at the outside of the housing sidewall, with a suitable spacer 51 between flange and sidewall at each side of the housing. To maintain the horizontal attitude of the plate, detent means are provided and, in the illustrated example, they include a pocket 52 secured to each sidewall of the housing near the rear end thereof and having a spring-loaded detent ball 53 projecting into the detent hole 54 in the flange such as 27 (FIG. 3A). An identical arrangement is provided at the inner wall 46 and flange 28 at the right-hand side of the unit, although this is not shown in FIG. 3B in view of the location of the cutting plane for section 3B. This detent ball normally keeps the plate in the horizontal position shown. However, if the teller has a package larger than can go in the vertical space between the lower edge 17 of the glass and the upper face 43 of the bottom of the plate, the teller can pull up on the knob 56 to tip the plate up to the position shown by the dotted outline 26A where the upper face 43 of the plate is stopped by engagement with the lower edge of the rear face of the glass at 17A. Then the teller can push the plate down to the exact opposite position, during which the package is pushed to the front of the line below the window as the front end portion of the plate moves upwardly opening the top front portion of the housing. Then the plate will stop in the position shown by the dotted line 26B when the top surface 43 of the plate engages the lower front edge of the window 17. Note that during this entire procedure, there is no time at which there is a direct line opening from the space in front of the window to the space behind the window. Therefore the teller is protected from the threat of a direct shot from a gun or knife or the like.

It is preferred that the housing and plate be made of stainless steel, although other materials might also be used. A typical dimension would be 18 inches long from front edge to rear edge of the flange 19, and 16 inches wide from the left side to the right side edge of the flange. The upper face 43 of the deal tray is typically 1½ inches below the plane of the countertop and lower edge 17 of the glass, and the radius of the inner surface of the housing is typically 7¾ inches.

While there have been described above the principles of this invention in connection with specific apparatus, it is to be clearly understood that this description is made only by way of example and not as a limitation in the scope of the invention.

What is claimed is:

1. A combination pass-through and deal tray comprising:

an upwardly opening housing having a front margin and a rear margin;

closure means in the upper portion of said housing, and normally closing the opening in the top of said housing, said closure means being operable to open the top of said housing to the bottom of said housing adjacent said front and rear margins alternately;

said housing being semi-cylindrical and having a front, rear, and bottom inner wall defined by an inner cylindrical surface having a horizontal cylindrical axis at a location between and spaced from the front and rear margins;

and said closure means including a plate mounted in the top portion of the housing and pivotable on said axis to open the space from the top of the housing to the bottom of the housing at the front of said axis and, alternatively, at the rear of said axis to permit passage of items under said plate; the top of said housing being above the horizontal plane containing said axis, said plate being below the top of said housing and having upwardly projecting front and rear end portions, said end portions being spaced below the top of said housing, and said upwardly projecting end portions cooperating with said front and rear inner walls to facilitate manual removal of thin flat objects from said plate when said plate is disposed horizontally and serving as a deal tray.

2. The combination of claim 1 wherein:

said housing has generally planar parallel horizontally spaced vertical side walls and said plate normally extends horizontally and longitudinally between locations adjacent said front and rear margins and immediately adjacent the inner cylindrical surface of the housing and laterally between lines immediately adjacent the inner faces of said side walls to cooperate with said housing and serve as a deal tray.

3. The combination of claim 2 wherein:

said plate has downwardly projecting longitudinally extending side flanges juxtaposed with the inside faces of said side walls, each of said side flanges having an aperture hole therein adjacent the rear end of said flange; and said side walls of said housing having detent balls mounted in sockets mounted on said side walls and spring-loaded to urge said balls inwardly into said holes to retain said plate in a horizontal housing-closing position.

4. The apparatus of claim 2 wherein:

said plate is slightly above the plane of the axis and at least one inch below the top of said housing;

and said plate has said front and rear end margins and front and rear end portions are upwardly turned to the end margins thereof, which end margins are spaced below the top of said housing approximately half the distance between an upper flat face of said plate and the top of said housing.

5. The apparatus of claim 4 and further comprising: a horizontally-disposed perimetrical flange projecting outwardly from the front and rear upper marginal edges and left and right upper side marginal edges of said housing and having downwardly projecting threaded studs therein for securing to a countertop.

6. The apparatus of claim 2 wherein:

said inner front wall curving upwardly and rearwardly above said plane toward the top of the housing;

said inner rear wall curving upwardly and forwardly above said plane toward the top of said housing.

* * * * *